US009981278B2

(12) United States Patent
Tu

(10) Patent No.: US 9,981,278 B2
(45) Date of Patent: May 29, 2018

(54) EXTENDED EMISSION TIME LIQUID SPRAYER

(71) Applicant: Zhejiang JM Industry Co., Ltd., Yuyao, Zhejiang Province (CN)

(72) Inventor: Xufeng Tu, Yuyao (CN)

(73) Assignee: Zhejiang JM Industry Co., Ltd., Yuyao (CN)

( * ) Notice: Subject to any disclaimer, the term of this patent is extended or adjusted under 35 U.S.C. 154(b) by 75 days.

(21) Appl. No.: 15/216,847

(22) Filed: Jul. 22, 2016

(65) Prior Publication Data

US 2017/0326566 A1 Nov. 16, 2017

Related U.S. Application Data

(63) Continuation-in-part of application No. 15/150,617, filed on May 10, 2016.

(51) Int. Cl.
*B05B 11/00* (2006.01)
*B05B 15/00* (2018.01)

(52) U.S. Cl.
CPC ..... *B05B 11/3025* (2013.01); *B05B 11/3011* (2013.01); *B05B 11/3014* (2013.01); *B05B 15/005* (2013.01); *B05B 15/30* (2018.02)

(58) Field of Classification Search
CPC ..... B05B 11/3011; B05B 11/0062; B05B 11/0051; B05B 11/3074; B05B 11/3095; B05B 11/3022; B05B 11/3004; B05B 11/304; B05B 11/3014; B05B 11/3025; B05B 11/0089
USPC ..... 222/491–497, 320–321.7, 383.1, 380, 222/335, 340
See application file for complete search history.

(56) References Cited

U.S. PATENT DOCUMENTS 2,772,031 A * 11/1956 Roselund ..... B05B 1/12 222/149
4,231,493 A * 11/1980 Kutik ..... B05B 11/3011 222/321.9
6,250,509 B1 * 6/2001 Fuchs ..... B05B 11/0021 222/321.6
8,038,036 B2 10/2011 Bruder et al.
2010/0243680 A1 * 9/2010 Tada ..... B05B 11/3011 222/383.1

FOREIGN PATENT DOCUMENTS

JP H05104041 4/1993
JP H10137642 4/1993
JP H09192552 7/1997

OTHER PUBLICATIONS

European Search Report dated Aug. 29, 2017 issued in related European application serial No. 17170481.0.

* cited by examiner

*Primary Examiner* — Nocholas J Weiss
*Assistant Examiner* — Robert Nichols, II
(74) *Attorney, Agent, or Firm* — Haugen Law Firm PLLP

(57) ABSTRACT

A liquid sprayer apparatus includes a multi-chamber spray mechanism, with at least one chamber being adapted to accumulate pressurized fluid for dispensation over an extended time period. The liquid sprayer apparatus is capable of emitting a liquid spray over a period of time that is substantially greater than a manual pump action applied to the trigger.

16 Claims, 11 Drawing Sheets

EXTENDED EMISSION TIME LIQUID SPRAYER

CROSS-REFERENCE TO RELATED APPLICATIONS

The present application is a continuation-in-part of U.S. patent application Ser. No. 15/150,617, filed May 10, 2016, entitled "EXTENDED EMISSION TIME LIQUID SPRAYER", the content of which being incorporated herein in its entirety.

FIELD OF THE INVENTION

The present invention relates to manual liquid sprayers generally, and more particularly to a liquid sprayer apparatus that permits semi-continuous emission with discontinuous manual pumping.

BACKGROUND OF THE INVENTION

Liquid spray apparatus are widely used in a variety of applications. The simplest form of a liquid spray apparatus involves a manual pump mechanically connected to a piston that operates to draw liquid from a container, and also to discharge liquid from a collection chamber. For many apparatus, a manual pump trigger is actuated by the user to move a piston in a collection chamber against a spring force to discharge liquid from the collection chamber out through an orifice. Upon release of force against the actuator, the spring force acts to push the piston back toward an initial position, wherein a reduced pressure is developed in the collection chamber as a motive force to drive liquid from the container into the collection chamber. Typically, one-way valves at the inlet and the outlet of the collection chamber control the collection and discharge of the liquid. In this common arrangement, liquid is dispensed from the sprayer only as the actuator is manipulated to move the piston through the collection chamber during the "discharge" portion of the cycle. In other words, liquid is not dispensed from the sprayer apparatus during the "collection" portion of the pumping cycle.

Another common type of liquid spray apparatus is a pressure sprayer, in which a pressure, typically pneumatic, is developed in a chamber through either manual or automatic means. Release from the pressure chamber is controlled by a valve that may be selectively operated by the user to introduce an elevated pressure into a liquid chamber, thereby driving liquid out from the liquid chamber through an orifice. Liquid emission will continue for so long as sufficient driving pressure is available in the pressure chamber. While pressure sprayers are useful for continuous spray applications, the mechanisms involved are typically more expensive to produce than the manual individual pump cycle spray apparatus described above, since pressure sprayers require a pressure chamber separate from the liquid chamber, and/or additional valving to accommodate the pressurization mechanism.

A need therefore exists for a liquid spray apparatus that is capable of continuous or semi-continuous emission in a compact and inexpensive manual pump spray mechanism. With such an apparatus, the user is able to maintain liquid emission for a period of time between pumping actions.

SUMMARY OF THE INVENTION

By means of the present invention, a liquid spray apparatus may exhibit a spray dispensation time that is substantially greater than a discharge phase of a pump cycle of a manual pump mechanism. The liquid spray dispensation time may be extended through the use of an adjustable volume dispensation chamber, in coordination with an outlet orifice of desired dimension. The adjustable volume dispensation chamber is facilitated by a movable piston acting against fluid pressure developed in the manual pumping action. Liquid spray dispensation initiates upon reaching a threshold fluid pressure in the dispensation chamber, and ceases when the fluid pressure drops below either the same or another threshold.

In one embodiment, a liquid sprayer apparatus includes a liquid container having an opening, and a spray mechanism sealingly engagable to the liquid container adjacent to the opening in order to fluidically communicate with an interior of the liquid container. The spray mechanism includes a main body defining a first channel with a first channel wall and a second channel with a second channel wall fluidically connected to each other through a first passage. A charge piston coordinates with the first channel wall to define a collection chamber, with the charge piston itself defining a third channel through which liquid may be introduced to the collection chamber. A one-way inlet valve permits liquid flow from the container to the collection chamber. The spray apparatus further includes a dispensation piston and a discharge valve base coordinating with the second channel wall to define a dispensation chamber, wherein the dispensation piston is responsive to a fluid pressure in the dispensation chamber. A one-way outlet valve permits liquid flow from the collection chamber to the dispensation chamber through the first passage. An actuator is provided with the spray apparatus for selectively moving the charge piston with respect to the first channel wall against a first restorative force to reduce a collection chamber volume of the collection chamber. A one-way discharge valve is provided to permit liquid flow from the dispensation chamber through a second passage in the discharge valve base, wherein the discharge valve includes a plunger with a sealing portion sealingly engagable with an aperture in a discharge valve seat structure, wherein the dispensation chamber is fluidly connected to the second passage through the aperture when the discharge valve is open with the sealing portion of the plunger disengaged from the discharge valve seat structure, the plunger being responsive to the fluid pressure in the dispensation chamber.

DETAILED DESCRIPTION OF THE PREFERRED EMBODIMENTS

Figure 1:
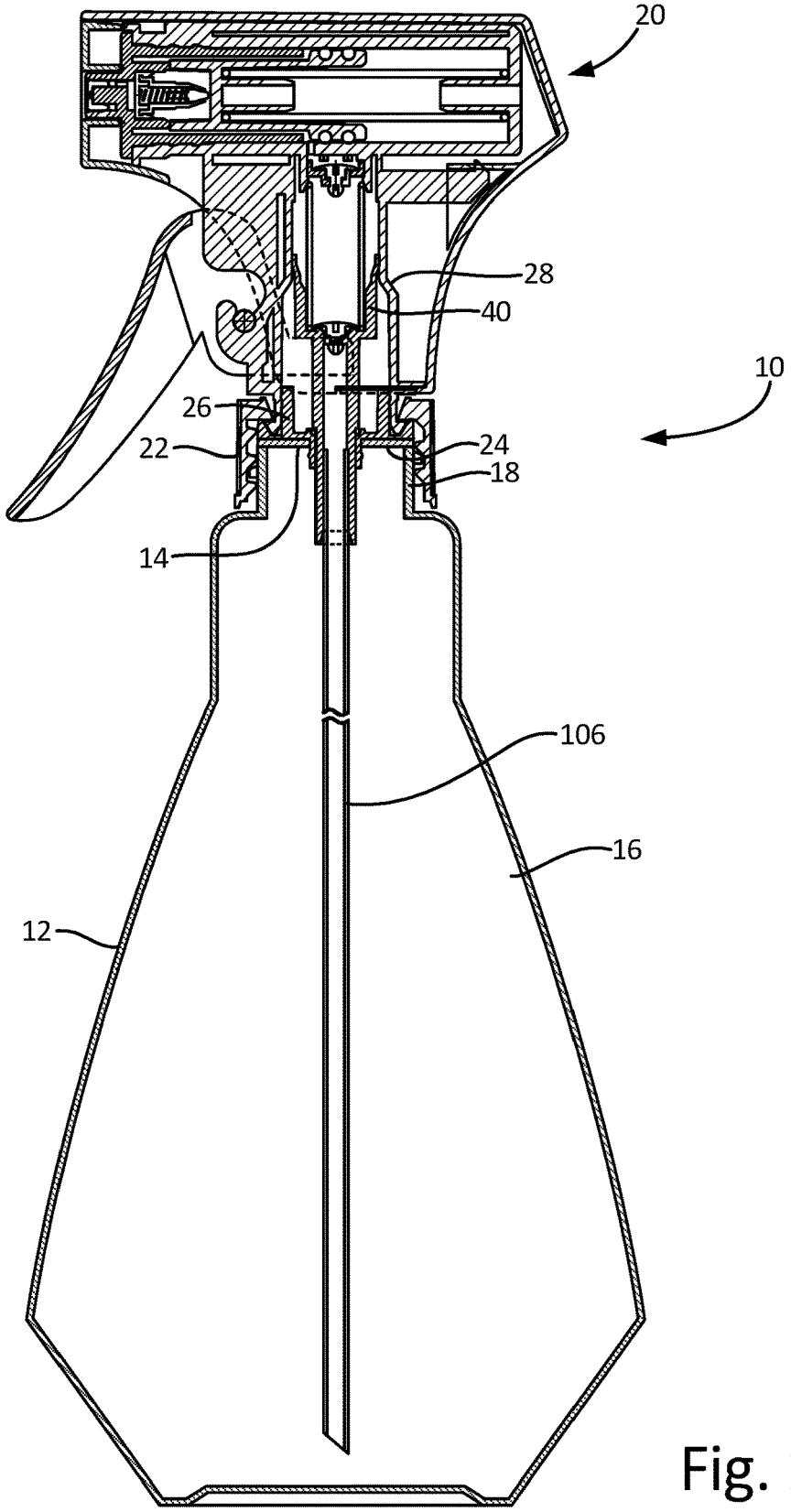
FIG. 1 is a cross-sectional view of a liquid sprayer apparatus of the present invention.
Figure 2:
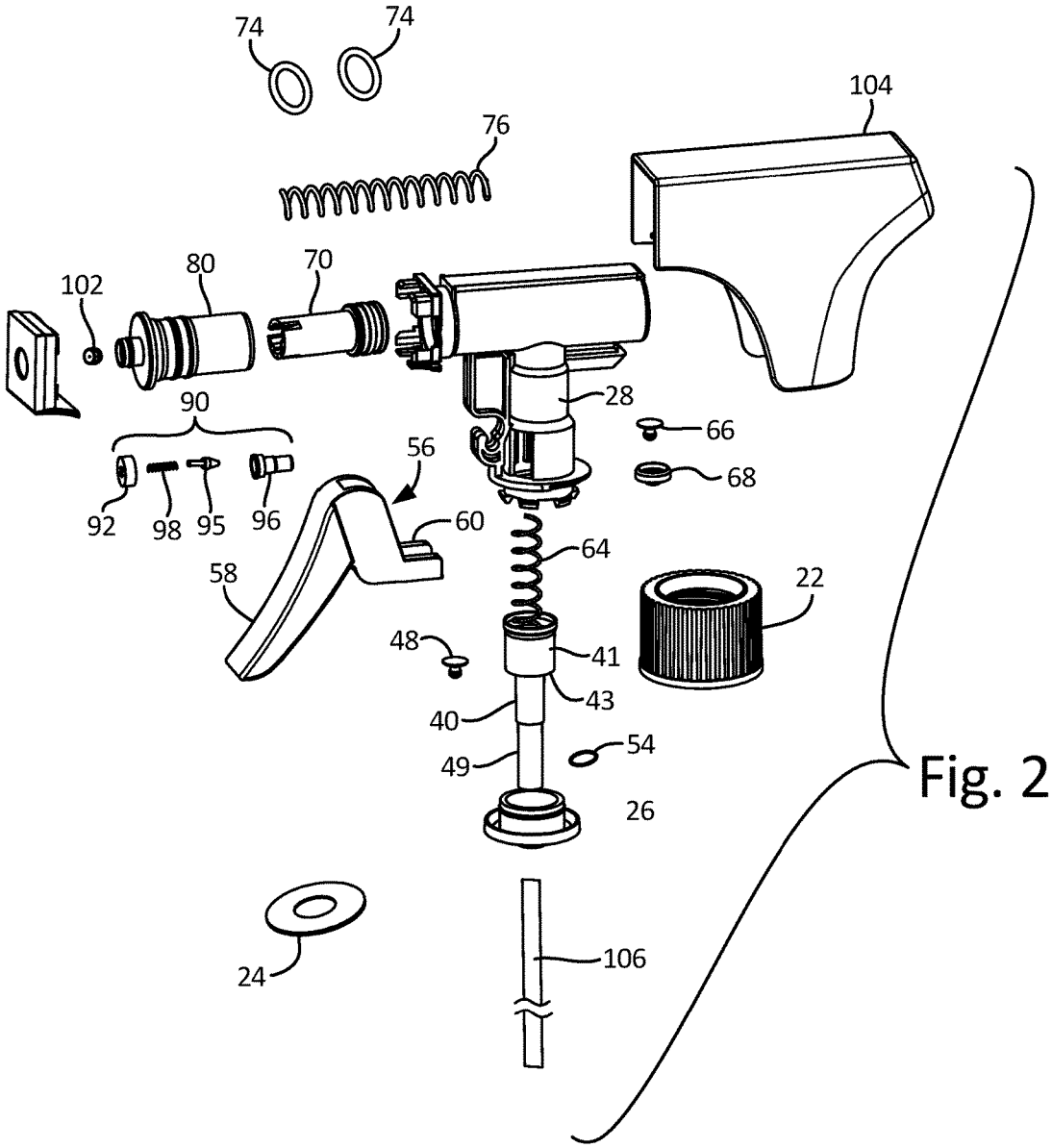
FIG. 2 is an exploded view of a portion of the liquid sprayer apparatus of the present invention.

The objects and advantages enumerated above together with other objects, features, and advances represented by the present invention will now be presented in terms of detailed embodiments described with reference to the attached drawing figures which are intended to be representative of various embodiments of the invention. Other embodiments and aspects of the invention are recognized as being within the grasp of those having ordinary skill in the art.

With reference now to the drawing figures, a liquid sprayer apparatus 10 includes a liquid container 12 and an opening 14 for access to interior 16 of liquid container 12. A neck 18 may surround opening 14, and may provide a convenient location for engagement with spray mechanism 20.

A skirt closure 22 may engage with neck 18, such as through a threadable engagement. A gasket 24 is supported by a valve base 26 to create a sealing engagement with neck 18 of liquid container 12 when skirt closure 22 securely engages with neck 18. Valve base 26 is secured to main body 28, which defines a first channel 30 with a first channel wall 32 and a second channel 34 with a second channel wall 36. The first and second channels 30, 34 of main body 28 may be fluidically connected through a first passage 38.

Figure 3:
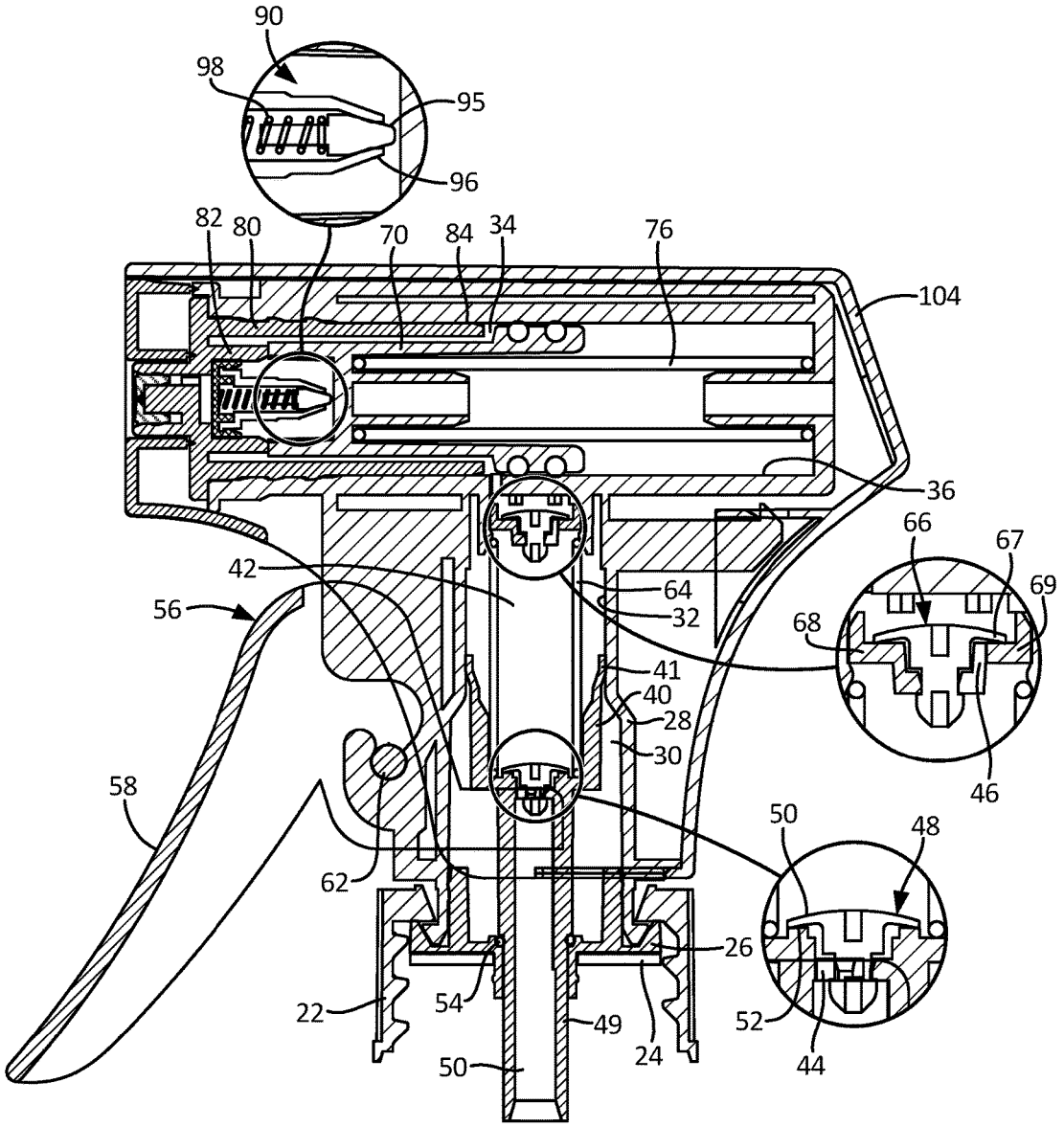
FIG. 3 is a cross-sectional view of a portion of the liquid sprayer apparatus of the present invention.

A charge piston 40 coordinates with first channel wall 32 to define a collection chamber 42 having a valve-controlled inlet 44 and a valve controlled outlet 46. As illustrated in FIG. 3, a one-way inlet valve 48 may be secured at a position to establish an openable seal with charge piston 40, and may particularly be positioned adjacent to a third channel 50 of charge piston 40 to control liquid passage from third channel 50 to collection chamber 42. One-way inlet valve 48 is illustrated in FIG. 3 in a closed condition, with a valve flange 50 contacting a valve seat surface 52 to block transmission of liquid into or out from collection chamber 42.

In the illustrated embodiment, charge piston 40 includes a first portion 41 that is in slidable engagement with first channel wall 32 to define at least a portion of collection chamber 42. Charge piston 40 includes a second portion 49 that defines third channel 50 through which fluid flow may be directed from liquid container 12 to collection chamber 42 (through valve-controlled inlet 44). Second portion 49 is slidable with respect to valve base 26, and sealingly engaged thereto with, for example, an O-ring gasket 54.

An actuator 56 includes a trigger portion 58 and a lift portion 60, wherein actuator 56 is secured to main body 28 at a pivot 62. Operation of actuator 56 occurs through the application and release of force against trigger portion 58, wherein an applied force against trigger portion 58 causes rotation of actuator 56 about pivot 62, which, in turn, rotates lift portion 60 about pivot 62. In the illustrated orientation, application of force against trigger portion 58 results in generally counter-clockwise rotation of lift portion 60 about pivot 62. Actuator 56 is mounted with lift portion 60 adjacent to bearing surface 43 of charge piston 40, so that rotational movement of lift portion 60 about pivot 62 moves charge piston 40 with respect to first channel wall 32. Such movement is applied against a first restorative force that is generated by, for example, a first spring 64. Other devices, such as elastic or resilient bodies, and the like are also contemplated as being capable of generating the first restorative force against charge piston 40. The first restorative force exerted upon charge piston 40 is transferred to actuator 56 at lift portion 60, to thereby act against an operation force applied to trigger portion 58. In the absence of an operational force upon trigger portion 58, therefore, actuator 56 is urged by first spring 64 to rotate about pivot 62 to a base condition. Movement of charge piston 40 with respect to first channel wall 32 adjusts a collection volume of collection chamber 42. In the illustrated embodiment, collection chamber 42 is defined by surfaces of one-way inlet valve 48, charge piston 40, first channel wall 32, one-way outlet valve 66, and outlet valve base 68 to which outlet valve 66 is secured. Outlet valve base 68 is secured to main body 28.

Spray mechanism 20 may further include a dispensation piston 70 that coordinates with second channel wall 36, as well as with a discharge valve base 80 and a discharge valve 90 to define a dispensation chamber 72 that is fluidically connected to collection chamber 42 through valve-controlled outlet 46 and first passage 38. In the embodiment illustrated in FIG. 3, one-way outlet valve 66 may include a flange 67 that contacts a seat portion 69 of outlet valve base 68 to block liquid transmission between collection chamber 42 and dispensation chamber 72 when outlet valve 66 is in a closed condition. Dispensation piston 70 is sealingly and slidably engaged with second channel wall 36. In some embodiments, one or more gaskets, such as O-ring type gaskets 74 are press-fit or otherwise position between dispensation piston 70 and second channel wall 36. Dispensation piston 70 is preferably responsive to a fluid pressure in dispensation chamber 72, wherein dispensation piston 70 is movable against a second restorative force to adjust a dispensation volume of dispensation chamber 72. Dispensation piston 70 may include a wall 76 that is displaceable in its position relative to countervailing forces acting upon it. In particular, fluid pressure in dispensation chamber 72 exerts a fluid force on dispensation piston 70, acting against the second restorative force that may be supplied by, for example, a second spring 76. Mechanisms other than second spring 76, such as elastic or resilient bodies, however, are contemplated as being useful in generating the second restorative force urging dispensation piston 70.

Discharge valve base 80 may be secured to main body 28 to aid in positioning discharge valve 90 and dispensation piston 70 in second channel 34. In some embodiments, one or more of stop flange 82 and end flange 84 of discharge valve base 80 may act as a stop limiter to arrest movement of dispensation piston 70 at the urging of the second restorative force in the absence or insufficiency of a fluid force exerted by a fluid pressure in dispensation chamber 72. The illustration of FIG. 3 shows dispensation piston 70 urged against stop flange 82 of discharge valve base 80. Stop flange 82 may also provide a mount location for discharge valve cap 92, which includes an aperture 94 for permitting liquid flow passing through discharge valve 90 to transmit to orifice 100 in nozzle 102.

Discharge valve 90 is arranged for permitting liquid flow from dispensation chamber 72 through a second passage 86 in discharge valve base 80, wherein discharge valve 90 opens when the fluid pressure in dispensation chamber 72 exceeds a first threshold pressure. In some embodiments, discharge valve 90 includes a plunger 95 urged into contact with a discharge valve seat structure 96 by a third restorative force when discharge valve 90 is in a closed condition. The third restorative force may, in some embodiments, be provided by a third spring 98, though other mechanisms are contemplated as providing the third restorative force in discharge valve 90 to permit one-way fluid flow out from dispensation chamber 72. Each of inlet valve 48, outlet valve 66, and discharge valve 90 are illustrated in FIG. 3 in a closed condition. Fluid flow through spray mechanism 20 will be described hereinbelow with reference to the drawings.

Figure 9:
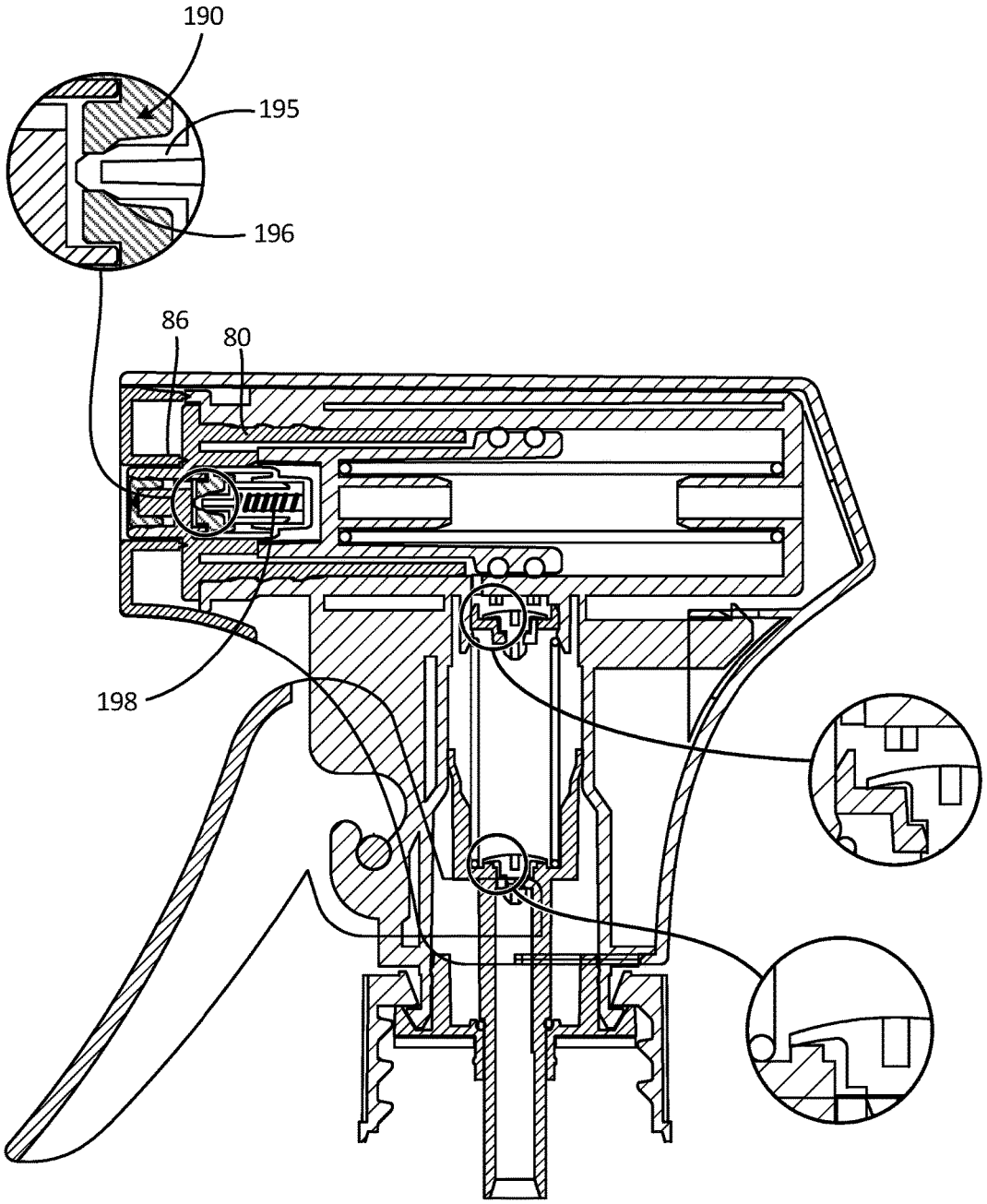
FIG. 9 is a cross-sectional view of a portion of the liquid sprayer apparatus of the present invention.
Figure 10:
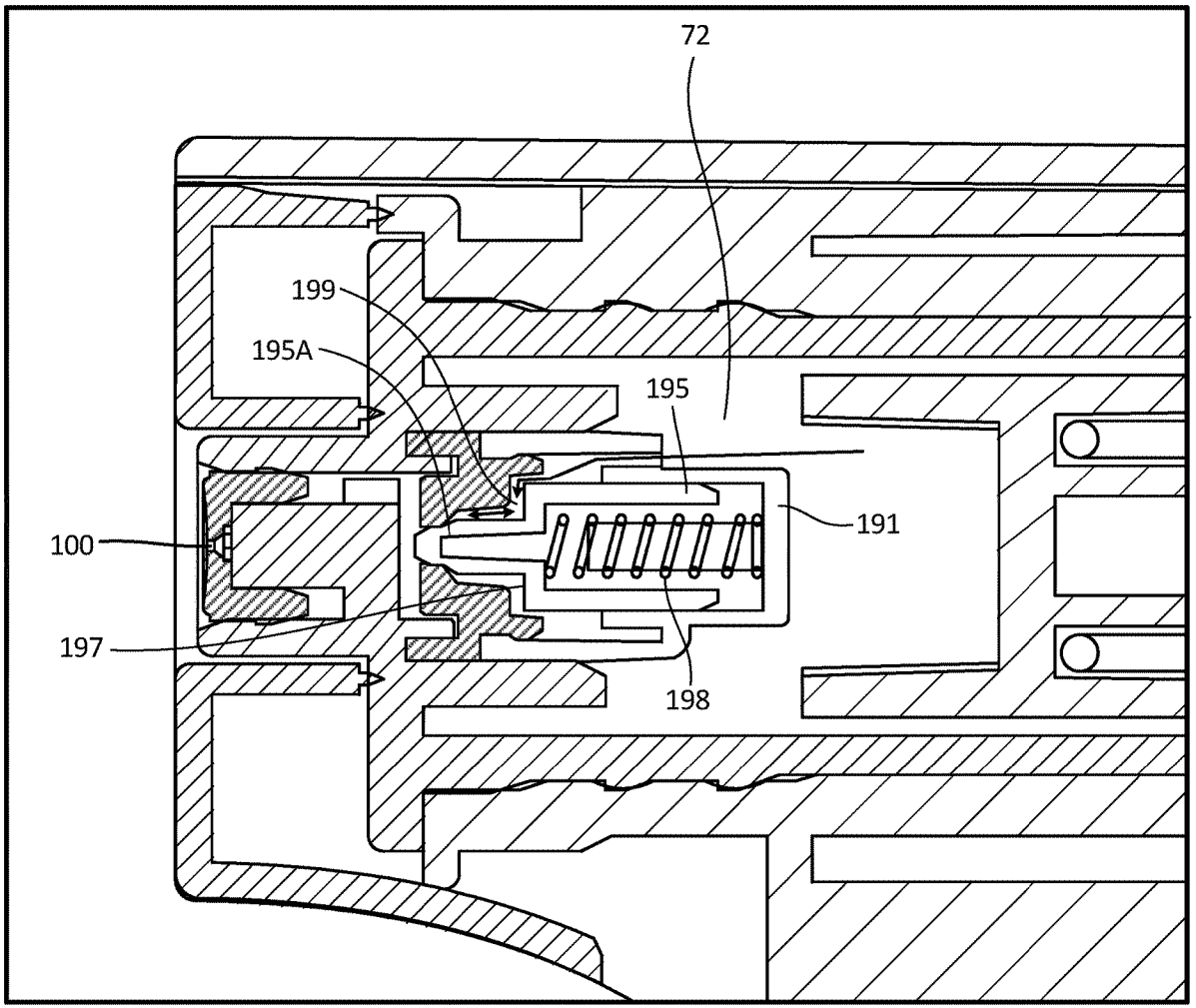
FIG. 10 is an enlarged cross-sectional view of a portion of the liquid sprayer apparatus of the present invention during a discharge phase of a pump cycle.
Figure 11:
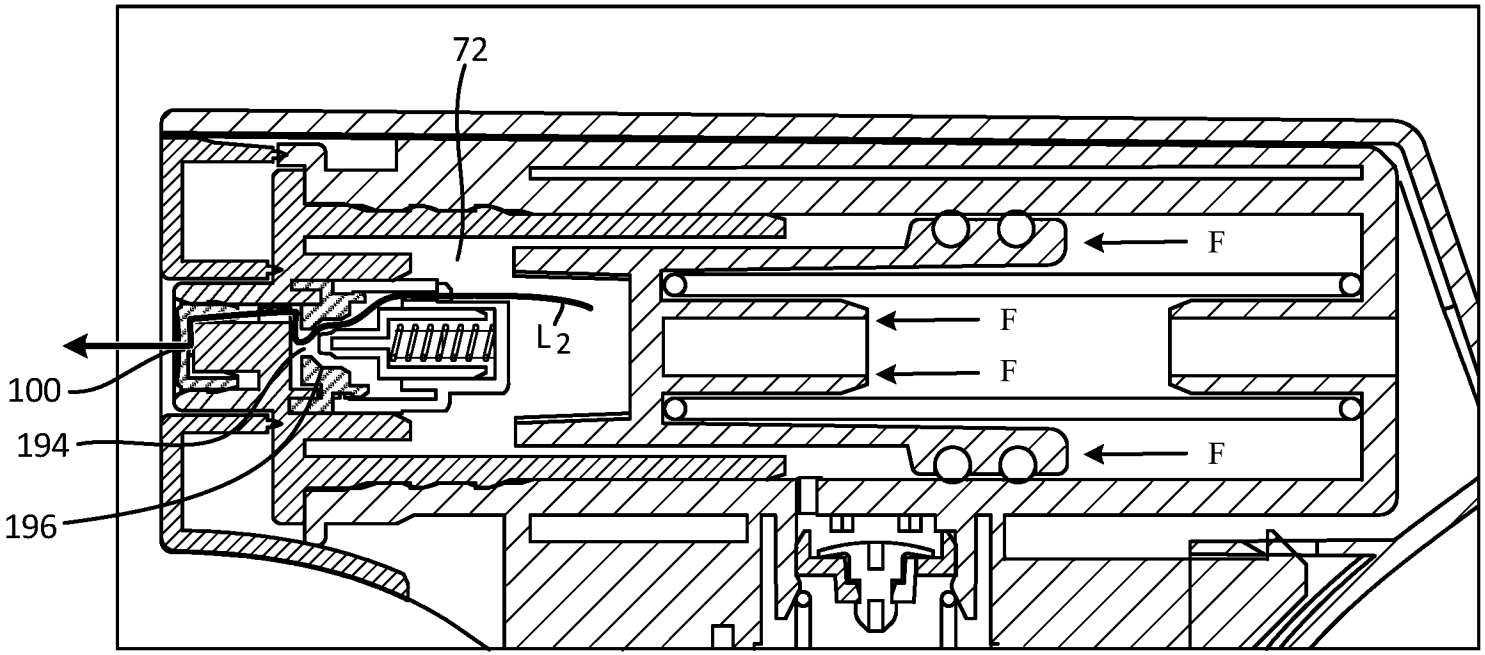
FIG. 11 is an enlarged cross-sectional view of a portion of the liquid sprayer apparatus of the present invention during liquid dispensation.

In another embodiment illustrated in FIG. 9, discharge valve 190 is arranged for permitting liquid flow from dispensation chamber 72 through second passage 86 in discharge valve base 80, wherein discharge valve 190 opens when the fluid pressure in dispensation chamber 72 exceeds a first threshold pressure. Discharge valve 190 includes a plunger 195 urged into contact with a discharge valve seat structure 196 by a third restorative force when discharge valve 190 is in a closed condition. The third restorative force may, in some embodiments, be provided by a third spring 198, though other mechanisms are contemplated as providing the third restorative force in discharge valve 190 to permit one-way fluid flow out from dispensation chamber 72. Discharge valve 190, as illustrated in FIGS. 9-11, includes a discharge valve support 191 that may slidably receive plunger 195 under the counteracting forces of spring 198 and fluid pressure within dispensation chamber 72. As illustrated in FIG. 10, fluid pressure acts upon plunger 195 against third spring 198 in a pressure chamber 199, and specifically against a shoulder surface 197 of plunger 195. The fluid pressure in dispensation chamber 72 is animated by the directional arrows applying force against shoulder portion 197, which, in turn acts against the third restorative force generated by third spring 198. As described in greater detail hereinbelow, and as illustrated in FIG. 11, when the fluid pressure in dispensation chamber 72 exceeds a threshold pressure, plunger 95 moves against third spring 198 to open discharge valve 190 through a separation between plunger 195 and dispensation valve seat 196. Such separation permits one-way fluid flow out from dispensation chamber 72, as depicted by the fluid motion arrows $L_2$ in FIG. 11.

A shroud 104 may be removably secured to main body 28 for both aesthetic and functional purposes. Tube 106 may be provided for conveying liquid from container 12 to third channel 50 of charge piston 40. In at least some embodiments, tube 106 may be connected to second portion 49 of charge piston 40, wherein tube 106 moves with charge piston 40, as driven by actuator 56 and first spring 64. Accordingly, tube 106 may preferably be sufficiently long to maintain submersion in the liquid in container 12 when tube 106 is moved upwardly with charge piston 40 during a pump cycle.

As described herein, an aspect of the present invention is the continuous or semi-continuous liquid emission from spray mechanism 20 during and between repeated pump cycles to actuator 56. The relationship among dispensation piston 70 and discharge valve 90, 190 with the fluid pressure in dispensation chamber 72 permits extended liquid discharge intervals that may continue for a period of time after actuator 56 (and charge piston 40) have ceased to be moved against the first restorative force. Such extended time liquid discharge may be facilitated by dispensation piston 70, and the potential energy accumulated by second spring 76 as a result of fluid pressure buildup in dispensation chamber 72. Conversion of the accumulated potential energy in second spring 76 to kinetic spring expansion energy may arise when a first threshold pressure in dispensation chamber 72 is exceeded, causing discharge valve 90, 190 to open and permit discharge of liquid from dispensation chamber 72 out through second passage 86, and ultimately out from spray mechanism 20 at orifice 100 of nozzle 102. In this manner, liquid discharge from spray mechanism 20 may occur independently from the operational status of actuator 56, in that liquid discharge may occur even when an operating force has been removed from trigger portion 58 to allow first spring 64 to urge charge piston 40 back to a base position.

Operation of an example embodiment of the present invention will now be described with reference to FIGS. 3-11, wherein FIGS. 3 and 9 illustrate a "base" condition for spray mechanism 20, in which each of inlet valve 48, outlet valve 66, and discharge valve 90, 190 are in a closed condition, and each of charge piston 40 and dispensation piston 70 are in a base position, urged by respective restorative forces against a support structure. In this condition, each of springs 64, 76, and 98, 198 may be in compression with respective restorative forces continuing to act against respective structures.

Figure 4:
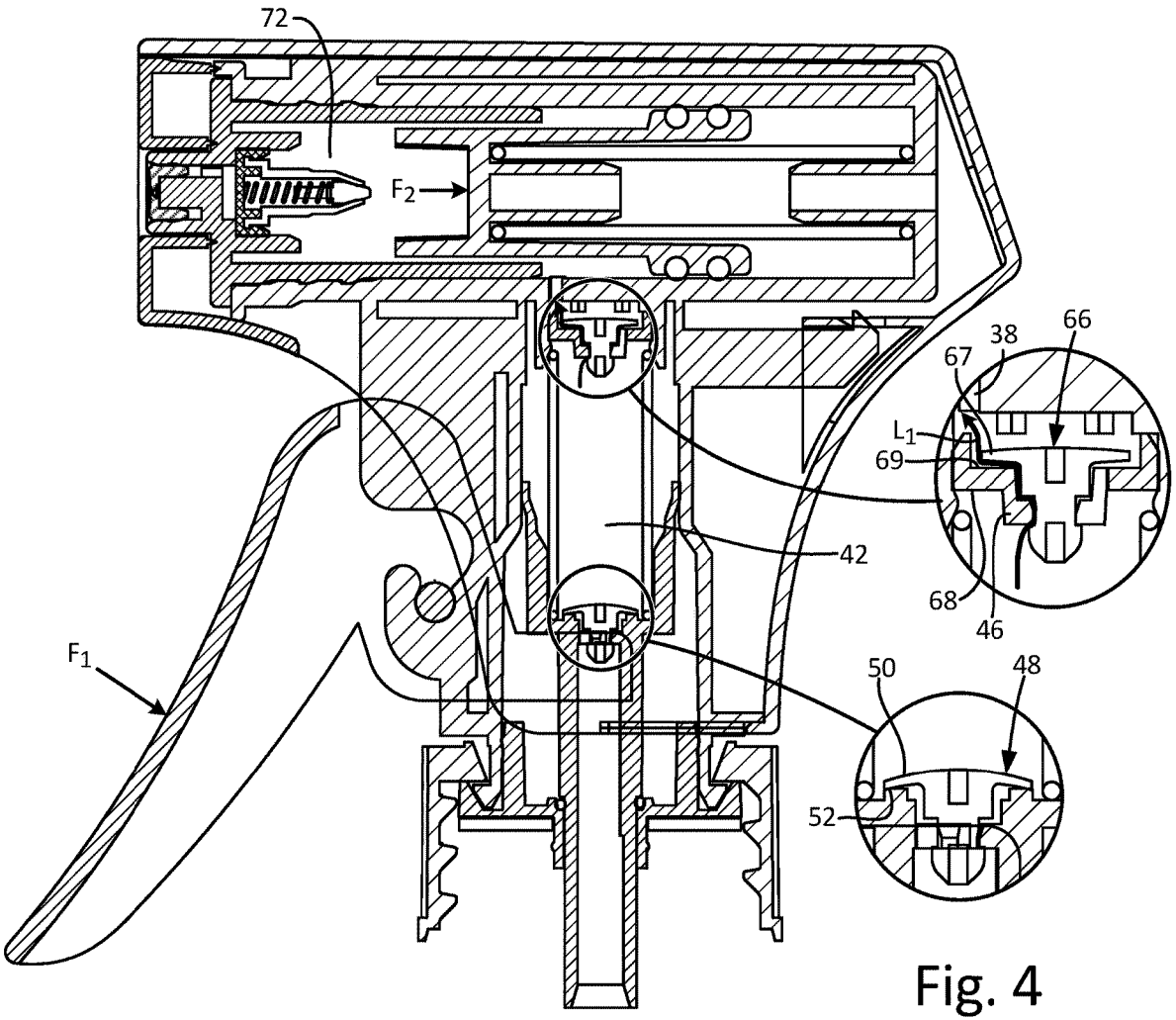
FIG. 4 is a cross-sectional view of a portion of the liquid sprayer apparatus of the present invention during a discharge phase of a pump cycle.

FIG. 4 represents a first phase of a pumping cycle in which an operating force "$F_1$" is applied by a user against trigger portion 58 of actuator 56 to correspondingly move charge piston 40 against the first restorative force developed by first spring 64. This movement of charge piston 40 reduces the collection volume of collection chamber 42, to force incompressible fluid out from collection chamber 42 through outlet 46 with outlet valve 66 forced into an open condition wherein outlet valve flange 67 is displaced from valve seat surface 69 of outlet valve base 68. The pathway of fluid flow out from collection chamber 42 through first passage 38 is demonstrated by arrow "$L_1$". This fluid flow continues into dispensation chamber 72, as illustrated in FIG. 4. During this discharge phase of the pumping cycle, inlet valve 48 remains in a closed condition, with valve flange 51 in contact with valve seat surface 52, thus preventing liquid from exiting collection chamber 42 through inlet 44.

Fluid entering into dispensation chamber 72 exerts a fluid pressure, which acts against all surfaces to which the liquid is exposed, including dispensation piston 70. The force "$F_2$" results in displacement of dispensation piston 70 against the second restorative force, thereby expanding the dispensation volume of dispensation chamber 72. Each of discharge valve 90, 190 and dispensation piston 70 represent movable structures exposed to fluid pressure in dispensation chamber 72. Such movable structures are adapted to yield to pressure, but preferably initially yield at different pressure thresholds, and may also yield at different yield rates. In particular, it is desired that dispensation piston 70 yields with movement against its second restorative force at a lower pressure than that required to cause plunger 95, 195 of discharge valve 90, 190 to yield with movement against its third restorative force. In this manner, as fluid pressure builds in dispensation chamber 72, dispensation piston 70 moves against its second restorative force before discharge valve 90, 190 opens.

In order to fulfill a purpose of the present invention, a mechanism is preferably provided to generate a dispensable liquid reservoir through a manual pumping action, wherein the liquid reservoir is released over a period of time that is equal to or greater than a pump cycle time period, which includes a "discharge phase" of operating actuator 56 to reduce volume in collection chamber 42, and a "collection"

phase in which force is removed from actuator 56 to permit collection chamber volume to expand with a new liquid charge. One approach for developing such a liquid reservoir may be to manually pump liquid into a chamber of fixed volume. Once the pressure in the fixed-volume reservoir exceeds a threshold pressure of an outlet valve, the outlet valve may open to dispense the liquid at a metered rate. Such an approach, however, would likely result in operational challenges, in that the manual pumping operation would require inequal and dramatically increasing force on actuator 56 in an effort to continue to fill an already "filled" fixed-volume chamber. In fact, due to the incompressible nature of many liquids, desired pressure buildup in the reservoir would quickly become impossible under typical manual pumping forces. Instead, dispensation chamber 72 of the present invention utilizes an adjustable-volume chamber 72 so that fluid pressure builds only with an increasing restorative force generated by second spring 64 as dispensation piston 72 is displaced against the increasing restorative force of second spring 64. This approach limits resistance to continued filling of dispensation chamber 72, while nevertheless generating a reservoir for extended time liquid dispensation from spray mechanism 20.

A measure of yield resistance for dispensation piston 70 and discharge valve 90, 190 may be defined herein as a "pressure resistance", which is determined as follows:

$$R=F/A$$

Wherein:

"F" is the respective restorative force applied against a movable structure exposed to fluid pressure in the dispensation chamber; and "A" is the effective surface area of movable structure exposed to fluid pressure in the dispensation chamber.

As described above, the restorative force applicable to dispensation piston 70 is the second restorative force, supplied in the illustrated example by second spring 76. The restorative force applicable to discharge valve 90, 190 is the third restorative force, generated in the illustrated example by third spring 98, 198 applied against plunger 95, 195. It should be understood that the applicable restorative force is dependent upon the mechanism employed to urge the movable structures against fluid pressure in dispensation chamber 72. In some embodiments, the restorative force may be determined or approximated pursuant to Hooke's Law, which is a principle that states that the force needed to extend or compress a spring by some distance is proportional to that distance:

$$F=k*X$$

Wherein:

"k" is a constant factor characteristic of the spring (stiffness); and

"X" is the displacement distance.

It should also be understood, however, that Hooke's Law is only a first-order linear approximation to the real response of springs and other elastic bodies to applied forces. The general principle, however, of increasing restorative force with increasing displacement from a neutral position holds true with respect to the restorative forces contemplated in the present invention. That is, as displacement of the movable body is increased, so too will the restorative force acting against the associated movable structure. In the case of the dispensation piston 70, for example, the second restorative force increases with displacement of dispensation piston 70 under the fluid force, $F_2$.

Figure 8:
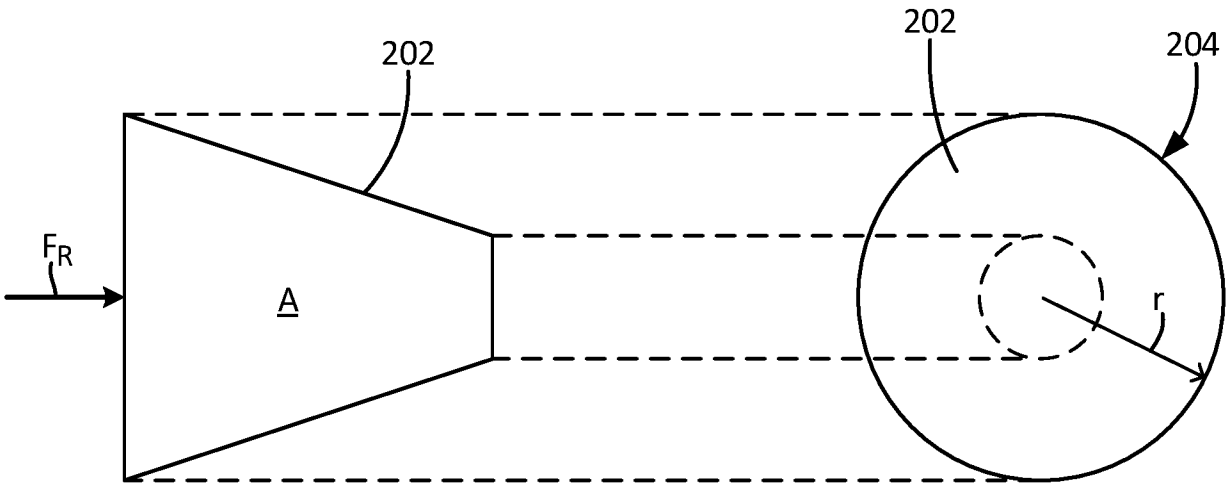
FIG. 8 is a schematic illustration of an effective surface area of a portion of the liquid sprayer apparatus of the present invention.

The effective surface area (A) of the movable structure exposed to fluid pressure in dispensation chamber 72 is defined herein as the area of a profile surface that is normal to the applicable restorative force. A schematic illustration of a profile surface area of a hypothetical frusto-conical movable structure analogous to plunger 95 of discharge valve 90 is illustrated in FIG. 8. As illustrated therein, surface 202 of body "A" is exposed to fluid pressure, with the applicable restorative force "$F_R$" is acting upon body A in the direction indicated. The effective surface area for the purposes of determining a pressure resistance of the present invention is the profile surface area 204 which, in the case of a frusto-conical body A, is the square of the radius dimension "r" multiplied by π. In the illustrated embodiment of spray mechanism 20, the effective surface area of dispensation piston 70 exposed to fluid pressure in dispensation chamber 72 is substantially greater than the effective surface area of plunger 95 exposed to the fluid pressure in dispensation chamber 72. With such an arrangement, in an example condition in which the second restorative force is equal to the third restorative force, the pressure resistance of the discharge valve 90 is substantially greater than the pressure resistance of dispensation piston 70. As described above with respect to changing restorative force with displacement, however, the relative pressure resistances among dispensation piston 72 and discharge valve 90 correspondingly changes with displacement of dispensation piston 70 against the second restorative force.

The profile surface area of plunger 195 of discharge valve 190 is the area of shoulder portion 197 normal to the third restorative force. As in the embodiment of discharge valve 90, the effective surface area of dispensation piston 70 exposed to fluid pressure in dispensation chamber 72 is substantially greater than the effective surface area of plunger 195 exposed to the fluid pressure in dispensation chamber 72.

Figure 5:
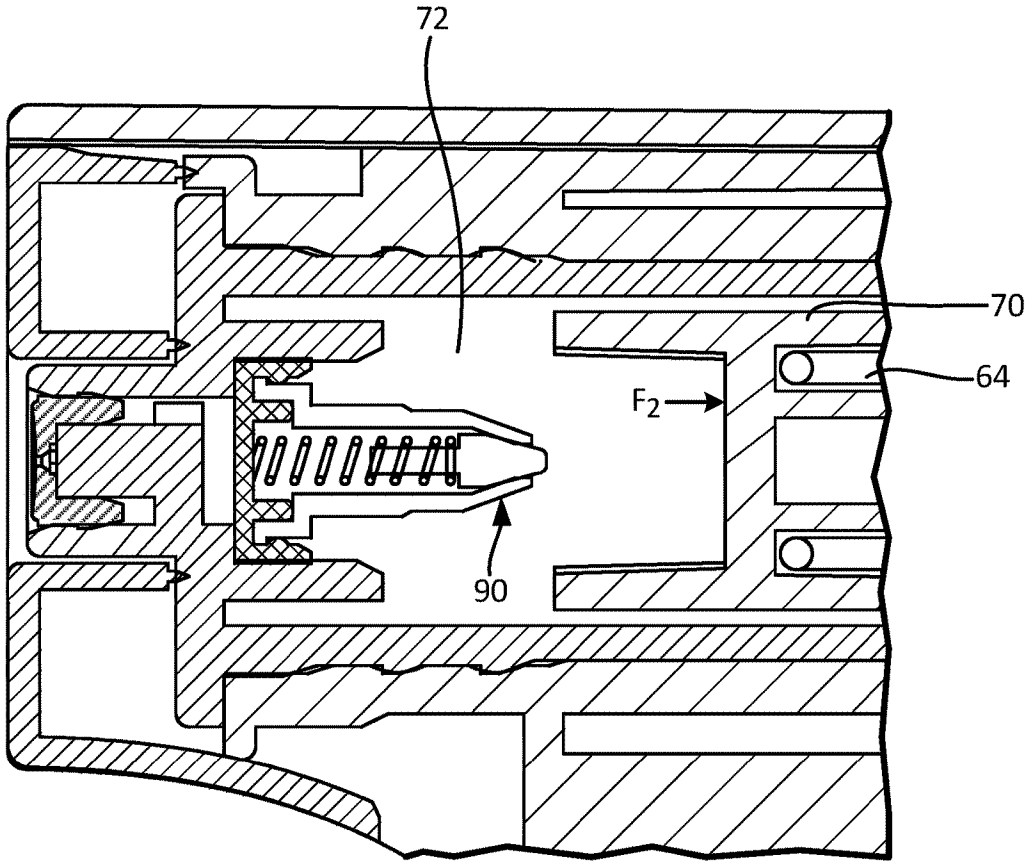
FIG. 5 is an enlarged view of a portion of the liquid sprayer apparatus of the present invention during a discharge phase of a pump cycle.

FIGS. 5 and 10 are enlarged views of a portion of spray mechanism 20 wherein a fluid pressure is present in dispensation chamber 72 sufficient to displace dispensation piston 70, but is less than the threshold pressure required to open discharge valve 90, 190. This condition is indicative of a first initial pressure resistance of discharge valve 90, 190 in a closed condition ("$R_V$") that is greater than a second initial pressure resistance of dispensation piston 70 in a rest condition ("$R_P$"). The "rest condition" of dispensation piston 70 is illustrated, for example, in FIGS. 3 and 9, but overall represents a condition in which dispensation piston 70 moves no further at the urging of second spring 76. Such condition may therefore be reached through either contact between dispensation piston 70 and another body, such as stop flange 82, or when second spring 76 reaches its neutral condition at which the second restorative force equals zero, because the displacement value (X) is zero. FIGS. 5 and 10 illustrate an embodiment in which second spring 64 is calibrated with a spring force (k) suitable to permit dispensation piston 70 to move against the second restorative force when the fluid pressure in dispensation chamber 72 is less than the threshold pressure required to open discharge valve 90, 190. In such an embodiment, the dispensation chamber volume expands with increasing fluid pressure in dispensation chamber 72, at least until the threshold pressure is reached.

Figure 6:
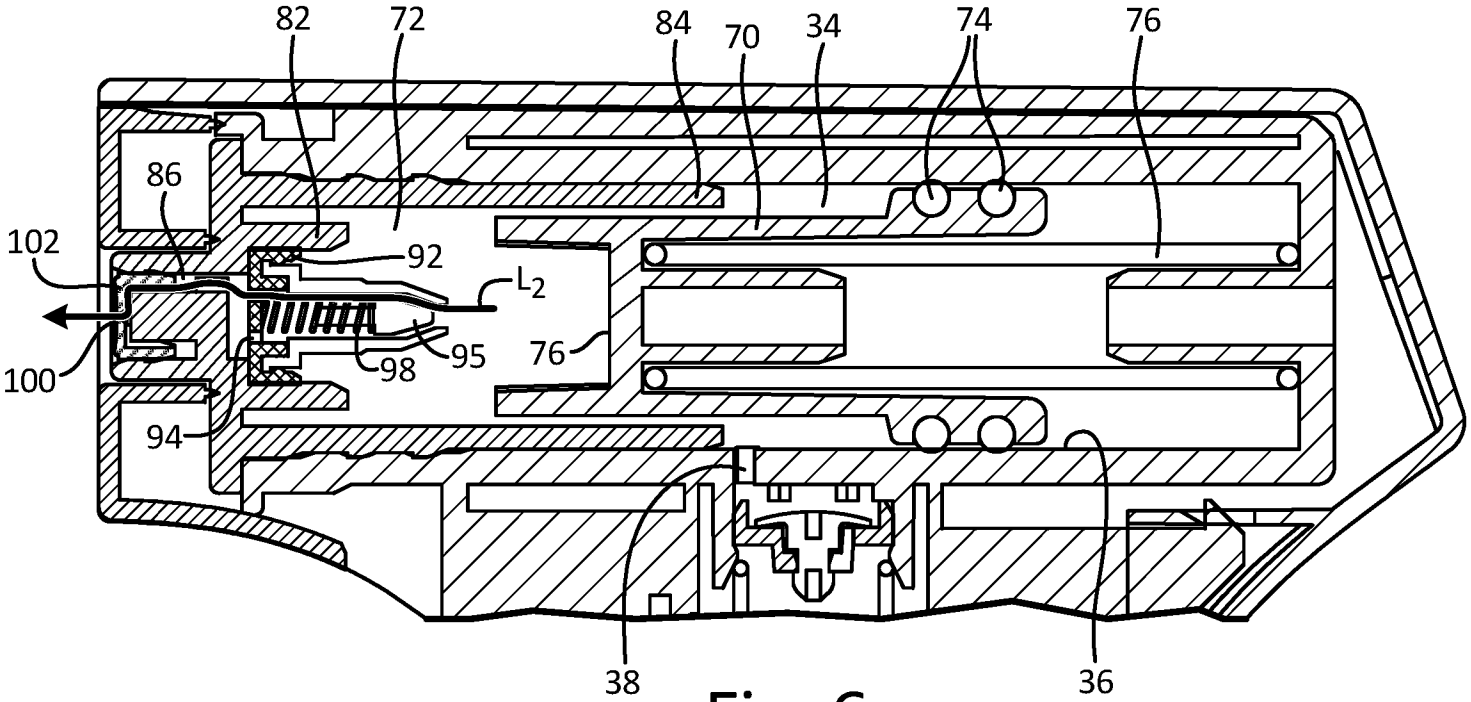
FIG. 6 is an enlarged cross-sectional view of a portion of the liquid sprayer apparatus of the present invention during liquid dispensation.

A further condition of spray mechanism 20 is illustrated in FIGS. 6 and 11, in which outlet valve 66 is closed subsequent to a pump discharge phase driving fluid from collection chamber 42 through first passage 38 into dispensation chamber 72. In the condition illustrated in FIGS. 6 and 11, fluid pressure in dispensation chamber 72 has displaced dispensation piston 70 to an extent at which a pressure resistance of dispensation piston 70 is equal to or greater than the first initial pressure resistance of discharge valve 90, 190. Fluid pressure in dispensation chamber 72 in FIGS. 6 and 11 is equal to or greater than the threshold fluid pressure, which causes plunger 95, 195 to move against the third restorative force exerted by third spring 98, 198. Discharge valve 90, 190 is illustrated in FIGS. 6 and 11 in an open condition permitting liquid flow along pathway $L_2$ through aperture 94, 194 and second passage 86, 186, and finally out from orifice 100. In some embodiments, the threshold fluid pressure is greater than a minimum fluid pressure required in dispensation chamber 72 to maintain discharge valve 90, 190 in an open condition. In other words, the "break" pressure required to open discharge valve 90, 190 may be greater than the fluid pressure required to maintain discharge valve 90, 190 in an open condition, such as with plunger 95, 195 separate from discharge valve seat structure 96, 196. A fluid pressure in dispensation chamber 72 that permits discharge valve 90, 190 to close may be termed a second threshold pressure, such that, in some embodiments, the first threshold pressure may be greater than the second threshold pressure.

To aid in extending the time period for dispensing liquid from spray mechanism 20 while discharge valve 90, 190 is in an open condition, orifice 100 may have a diameter that develops a desired flow restriction, thereby generating a back pressure to liquid flow out from orifice 100. In one aspect of the present invention, a liquid dispensing time is at least twice the discharge phase time of the pump cycle, and may more preferably be at least thrice the discharge phase time of the pump cycle. For the purposes hereof, the term "dispensation time" means the time of liquid dispensation out from orifice 100 for each discharge valve opening cycle, which itself is defined by the cycle from discharge valve open to discharge valve close. For the purposes hereof, the term "discharge phase time" is intended to mean the time of movement of charge piston 40 in forcing liquid from collection chamber 42 through outlet 46 for each pump cycle operation applied to actuator 56. By way of example, one discharge phase occurs during the time that a user depresses actuator 56. In some embodiments, orifice 100 may be in the range of between about 0.3-0.5 mm and more preferably between about 0.35-0.45 mm. Such diameter range is exemplary only for a particular embodiment, and is intended to demonstrate an appropriate orifice size for generating a flow restriction suitable to extend liquid dispensation cycle times.

Discharge valve 190 is preferably configured to close aperture 194 immediately upon the fluid pressure in dispensation chamber 72 falling below the threshold pressure and, in some embodiments, below the first threshold pressure. It is desirable that liquid flow along pathway $L_2$ out from orifice 100 changes abruptly from an "on" condition to an "off" condition. To do so, plunger 195 is arranged to immediately re-seat with discharge valve seat structure 196 with a corresponding drop in fluid pressure in dispensation chamber 72. Thus, plunger 195 preferably includes a sealing portion 195A that quickly engages with discharge valve seat structure 196 and effectively closes aperture 194 to thereby close discharge valve 190. In the illustrated embodiment, sealing portion 195*a* of plunger 195 may have a substantially frusto-conical configuration that is engagable into a correspondingly-configured aperture 194 of discharge valve seat structure 196 to close discharge valve 190.

Figure 7:
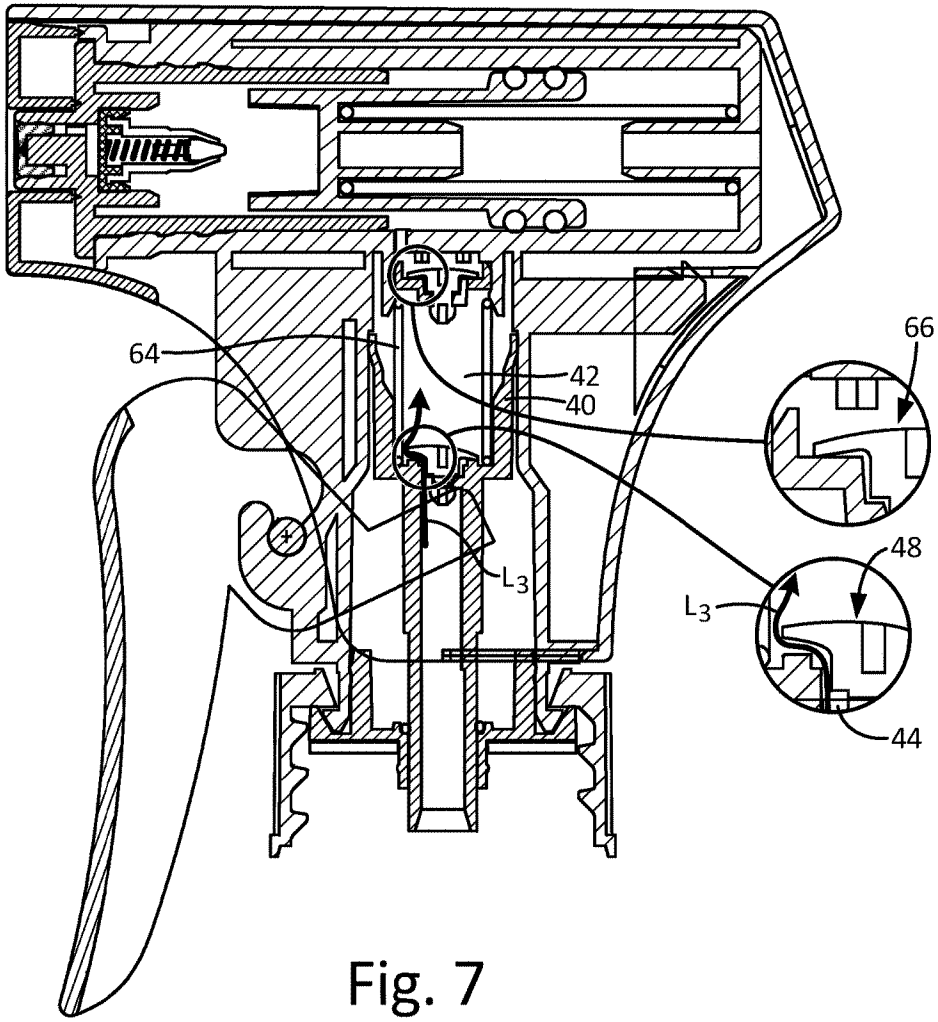
FIG. 7 is a cross-sectional view of a portion of the liquid sprayer apparatus of the present invention during a collection phase of a pump cycle.

FIG. 7 illustrates the "collection phase" of the pump cycle, wherein the force $F_1$ is either reduced or removed from trigger portion 58 of actuator 56, to permit the first restorative force to move charge piston 40 back toward a base position, as illustrated in FIG. 3. In this illustrated condition, outlet valve 66 is in a closed condition, while inlet valve 48 is forced into an open condition as a consequence of a reduced pressure in collection chamber 42. The reduced pressure is developed as a consequence of the expanding collection chamber volume of collection chamber 42 with first spring 64 acting with the first restorative force against charge piston 40. The reduced pressure developed in collection chamber 42 is sufficient to draw liquid from container 12 through tube 106 and third channel 50 to open inlet valve 48 for passage into collection chamber 42. Direction arrow "$L_3$" illustrates the liquid flow from container 12 through inlet 44 into collection chamber. Return of charge piston 40 to its base position substantially fills collection chamber 42 with liquid, and substantially equalizes fluid pressure between collection chamber 42 and interior 16 of liquid container 12. Inlet valve 48 thus re-closes, preventing drainage of liquid from collection chamber 42 through inlet 44.

The invention has been described herein in considerable detail in order to comply with the patent statutes, and to provide those skilled in the art with the information needed to apply the novel principles and to construct and use embodiments of the invention as required. However, it is to be understood that various modifications may be accomplished without departing from the scope of the invention itself.

What is claimed is:

1. A liquid sprayer apparatus, comprising:

a liquid container having an opening;

a spray mechanism sealingly engageable to said liquid container adjacent said opening to fluidically communicate with an interior of said liquid container, said spray mechanism including:

(i) a main body defining a first channel with a first channel wall and second channel with a second channel wall, wherein the first channel and the second channel are fluidically connected to each other through a first passage;

(ii) a charge piston coordinating with said first channel wall to define a collection chamber, said charge piston defining a third channel extending therethrough, for introducing liquid to said collection chamber;

(iii) a one-way inlet valve permitting liquid flow from said container to said collection chamber;

(iv) a dispensation piston and a discharge valve base coordinating with said second channel wall to define a dispensation chamber, said dispensation piston being responsive to a fluid pressure in said dispensation chamber against a second restorative force;

(v) a one-way outlet valve permitting liquid flow from said collection chamber to said dispensation chamber through said first passage;

(vi) an actuator for selectively moving said charge piston with respect to said first channel wall against a first restorative force to reduce a collection chamber volume of said collection chamber; and (vii) a one-way discharge valve for permitting liquid flow from said dispensation chamber through a second passage in said discharge valve base, wherein said one-way discharge valve includes a plunger with a sealing portion sealingly engageable with an aperture in a discharge valve seat structure, wherein said dispensation chamber is fluidly connected to said second passage through said aperture when said one-way discharge valve is open with said sealing portion of said plunger disengaged from said discharge valve seat structure, said plunger being responsive to the fluid pressure in said dispensation chamber.

2. A liquid sprayer apparatus as in claim 1 wherein said plunger is urged against the fluid pressure by a third restorative force.

3. A liquid sprayer apparatus as in claim 2 wherein said third restorative force acts along a direction that is substantially parallel to a liquid flow direction through said aperture.

4. A liquid sprayer apparatus as in claim 2 wherein said discharge valve opens when the fluid pressure in said dispensation chamber exceeds a first threshold pressure.

5. A liquid sprayer apparatus as in claim 4, including a first spring capable of exerting said first restorative force against said charge piston.

6. A liquid sprayer apparatus as in claim 5, including a second spring capable of exerting said second restorative force against said dispensation piston.

7. A liquid sprayer apparatus as in claim 6 wherein said second spring is calibrated to permit said dispensation piston to move against said second restorative force when the fluid pressure in said dispensation chamber is less than said threshold pressure.

8. A liquid sprayer apparatus as in claim 7 wherein a dispensation chamber volume expands with increasing fluid pressure in said dispensation chamber at least until said first threshold pressure is reached.

9. A liquid sprayer apparatus as in claim 8 wherein said discharge valve closes when the fluid pressure in said dispensation chamber falls below a second threshold pressure.

10. A liquid sprayer apparatus as in claim 9 wherein said first threshold pressure is greater than said second threshold pressure.

11. A liquid sprayer apparatus as in claim 1 wherein said discharge valve is connected to said discharge valve base.

12. A liquid sprayer apparatus as in claim 1, including a tube for conveying liquid from said container to said third channel of said charge piston.

13. A liquid sprayer apparatus, comprising:

a liquid container having an opening;

a spray mechanism sealingly engageable to said liquid container adjacent said opening to fluidically communicate with an interior of said liquid container, said spray mechanism including:

(i) a main body defining a first channel with a first channel wall and a second channel with a second channel wall, wherein the first channel and the second channel are fluidically connected to each other through a first passage;

(ii) a charge piston coordinating with said first channel wall to define a collection chamber, said charge piston defining a third channel extending therethrough, for introducing liquid to said collection chamber;

(iii) a one-way inlet valve permitting liquid flow from said container to said collection chamber;

(iv) a dispensation piston being responsive to fluid pressure in said second channel against a second restorative force;

(v) a one-way outlet valve permitting liquid flow from said collection chamber to said second channel through said first passage;

(vi) an actuator for selectively moving said charge piston with respect to said first channel wall against a first restorative force to reduce a collection chamber volume of said collection chamber; and (vii) a discharge orifice at which fluid is dispensable from said spray mechanism (viii) a discharge valve base secured to said second channel wall, and defining a second passage therethrough fluidically communicating with the discharge orifice;

(ix) an annular discharge valve seat structure surrounding an aperture; and (x) a one-way discharge valve including a plunger with a seating portion that is sealingly engageable with said annular discharge valve seat structure to close said aperture, said plunger being responsive to a fluid pressure in said second channel against a third restorative force to open said aperture, wherein disengagement of said seating portion of said plunger from said annular discharge valve seat structure permits fluid flow through said aperture, and through said second passage to the discharge orifice.

14. The liquid sprayer apparatus as in claim 13 wherein said annular discharge valve seat structure is secured to said discharge valve base.

15. The liquid sprayer apparatus as in claim 14 wherein said discharge valve base is secured within said second channel wall.

16. The liquid sprayer apparatus as in claim 15 wherein said second restorative force urges said plunger along a first direction to close said aperture by sealingly engaging said seating portion with said discharge valve seat structure, and wherein fluid flow through said aperture is generally along the first direction.

* * * * *